US008992287B2

(12) United States Patent
Wang et al.

(10) Patent No.: US 8,992,287 B2
(45) Date of Patent: Mar. 31, 2015

(54) SLURRY SUPPLY SYSTEM FOR CMP PROCESS

(75) Inventors: Sheng-Chen Wang, Taichung (TW); Feng-Inn Wu, Hsinchu (TW); Chih-Hung Tsai, Taichung (TW); Huang-Jen Hsu, Hsinchu (TW); Te-Chia Hsu, Zhubei (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 543 days.

(21) Appl. No.: 13/308,706

(22) Filed: Dec. 1, 2011

(65) Prior Publication Data

US 2013/0143474 A1 Jun. 6, 2013

(51) Int. Cl.
*B24B 57/02* (2006.01)
*B24C 7/00* (2006.01)

(52) U.S. Cl.
CPC *B24B 57/02* (2013.01); *B24C 7/003* (2013.01)
USPC ..... 451/60; 451/99

(58) Field of Classification Search
CPC ..... B24B 57/00; B24B 57/02; B24C 7/00; B24C 7/003
USPC ..... 451/60, 99
See application file for complete search history.

(56) References Cited

U.S. PATENT DOCUMENTS

| | | | | |
|---|---|---|---|---|
| 6,024,829 | A * | 2/2000 | Easter et al. | 156/345.12 |
| 6,126,531 | A | 10/2000 | Iida et al. | |
| 6,315,644 | B1 * | 11/2001 | Cho et al. | 451/60 |
| 6,352,469 | B1 * | 3/2002 | Miyazaki et al. | 451/67 |
| 6,406,364 | B1 * | 6/2002 | Kimura et al. | 451/446 |
| 6,585,570 | B2 * | 7/2003 | Kim et al. | 451/60 |
| 6,743,081 | B2 * | 6/2004 | Chen | 451/60 |
| 2010/0224256 | A1 | 9/2010 | Tseng et al. | |

FOREIGN PATENT DOCUMENTS

GB 2347878 A * 9/2000 ..... B24B 57/00

* cited by examiner

*Primary Examiner* — Maurina Rachuba
(74) *Attorney, Agent, or Firm* — Eschweiler & Associates, LLC

(57) ABSTRACT

The present disclosure relates to a slurry distribution system having a distribution tube connected between a mixing tank and a CMP tool. The mixing tank is configured to generate a polishing mixture comprising a diluted slurry having abrasive particles that enable mechanical polishing of a workpiece. The polishing mixture is transported between the mixing tank and a CMP tool by way of a transport piping. An energy source, in communication with the transport piping, transfers energy to the abrasive particles within the polishing mixture, thereby preventing accumulation of the abrasive particles within the transport piping.

20 Claims, 6 Drawing Sheets

SLURRY SUPPLY SYSTEM FOR CMP PROCESS

BACKGROUND

Integrated chips are constructed using complex fabrication processes that form a plurality of different layers on top of one another. Many of the layers are patterned using photolithography, in which a light sensitive photoresist material is selectively exposed to light. For example, photolithography is used to define back end metallization layers that are formed on top of one another. To ensure that the metallization layers are formed with a good structural definition, the patterned light must be properly focused. To properly focus the pattered light, a workpiece must be substantially planar to avoid depth of focus problems.

Chemical mechanical polishing (CMP) is a widely used process by which both chemical and physical forces are used to globally planarize a semiconductor workpiece. The planarization prepares the workpiece for the formation of a subsequent layer. A typically CMP system comprises a rotating platen covered by a polishing pad. A slurry distribution system is configured to provide a polishing mixture, having abrasive components, to the polishing pad. A workpiece is then brought into contact with the pad, causing the rotating platen to planarize the workpiece.

SUMMARY

The following presents a simplified summary in order to provide a basic understanding of one or more aspects of the disclosure. This summary is not an extensive overview of the disclosure, and is neither intended to identify key or critical elements of the disclosure, nor to delineate the scope thereof. Rather, the primary purpose of the summary is to present some concepts of the disclosure in a simplified form as a prelude to the more detailed description that is presented later.

In some embodiments, the present disclosure relates to a slurry distribution system for a chemical mechanical polishing tool. The slurry distribution system comprises a mixing tank configured to generate a polishing mixture comprising a diluted slurry mixture having abrasive particles that enable mechanical polishing of a workpiece. A transport piping is configured to transport the polishing mixture between the mixing tank and a chemical mechanical polishing (CMP) tool. An energy source is in direct communication with the transport piping. The energy source is configured to transfer energy to the abrasive particles within the transport piping, thereby preventing accumulation of the abrasive particles within the transport piping.

In another embodiment, the present disclosure relates to a slurry distribution system for a chemical mechanical polishing tool. The slurry distribution system comprises a mixing tank configured to generate a polishing mixture comprising a diluted slurry mixture having abrasive particles that enable mechanical polishing of a workpiece. A double tube is connected between the mixing tank and a chemical mechanical polishing (CMP) tool. The double tube comprises a first tube configured to transport the polishing mixture between the mixing tank and the CMP tool and a second tube configured to transport a stimulating liquid. An energy source is configured to transfer energy to the stimulating liquid, which subsequently transfers the energy to the abrasive particles within the first tube, thereby preventing accumulation of the abrasive particles within the first tube.

In another embodiment, the present disclosure relates to a method for distributing slurry for a chemical mechanical polishing tool. The method comprises transporting a polishing mixture comprising a diluted slurry mixture having abrasive particles between a mixing tank and a chemical mechanical polishing tool by way of a first tube. Energy is provided to a stimulating element in contact with the first tube over a majority of a length of the first tube, wherein the stimulating element is configured to transfer energy to the abrasive particles within the first tube, thereby preventing accumulation of the abrasive particles within the first tube.

The following description and annexed drawings set forth in detail certain illustrative aspects and implementations of the disclosure. These are indicative of but a few of the various ways in which the principles of the disclosure may be employed.

DETAILED DESCRIPTION

Figure 1A:
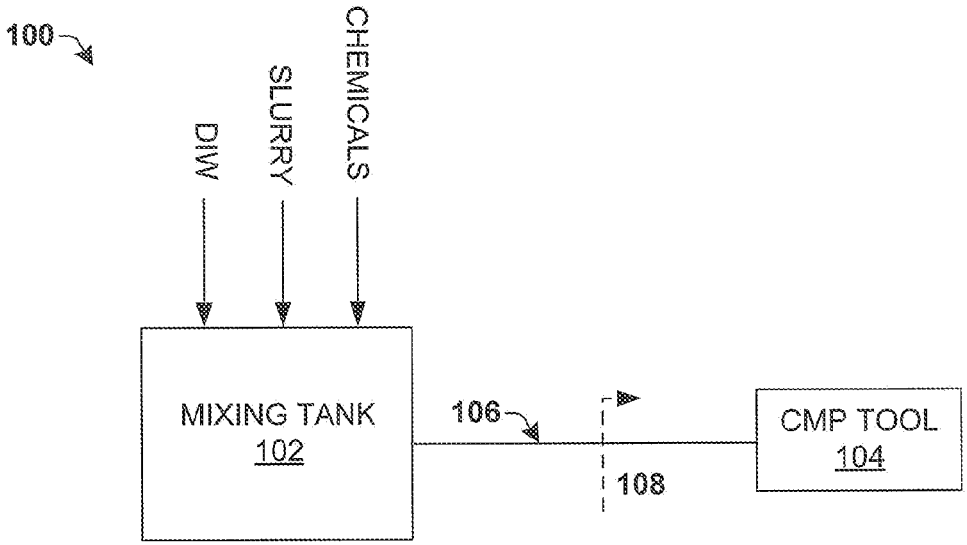
FIG. 1*a* illustrates block diagram of a typical slurry distribution system.

The description herein is made with reference to the drawings, wherein like reference numerals are generally utilized to refer to like elements throughout, and wherein the various structures are not necessarily drawn to scale. In the following description, for purposes of explanation, numerous specific details are set forth in order to facilitate understanding. It may be evident, however, to one of ordinary skill in the art, that one or more aspects described herein may be practiced with a lesser degree of these specific details. In other instances, known structures and devices are shown in block diagram form to facilitate understanding.

FIG. 1*a* illustrates a block diagram of a slurry distribution system 100. The slurry distribution system 100 comprises a mixing tank 102 configured to mix a concentrated slurry with de-ionized water to form a polishing mixture. The polishing mixture is transported from the mixing tank 102 to one or more chemical mechanical polishing (CMP) tools 104 by way of a transport piping 106.

Figure 1B:
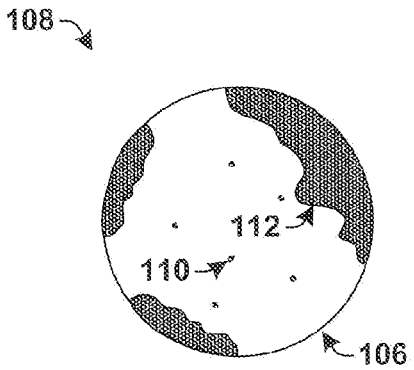
FIGS. 1*b*-1*c* illustrate cross sectional view of a transport piping connecting a mixing tank and a chemical mechanical polishing tool within the slurry distribution system of FIG. 1*a*.

FIG. 1*b* illustrates a cross sectional view 108 of a transport piping 106 in slurry distribution system 100. During transport of the polishing mixture, abrasive particles 110 within the polishing mixture precipitate from the polishing mixture and condense on sidewalls of the transport piping 106. Over time, the condensation of abrasive particles 110 within the polishing mixture builds up on the sidewalls of the transport piping 106, resulting in relatively large accumulations 112 of abrasive particles.

Figure 1C:
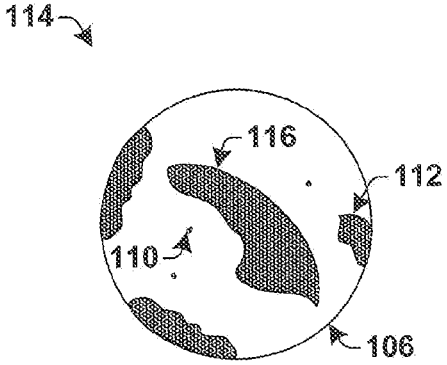

The inventors have appreciated large chunks of the accumulations 112 can break loose from the sidewall of the transport piping 106. As shown in the cross sectional view 114 of FIG. 1*c*, the chunks of accumulation 116 can travel through the transport piping 106 to the one or more CMP tools 104 (e.g., shown in FIG. 1*a*). When the large chunks of accumulation 116 are provided to the one or more CMP tools 104, they are brought into contact with a workpiece during the polishing process. In contrast to the relatively small abrasive particles 110, which aid in the CMP polishing process, the large chunks of accumulation 116 result in micro-scratches and other defects within the surface of the workpiece.

Accordingly, some aspects of the present disclosure provide for a slurry distribution system for a chemical mechanical polishing (CMP) tool that prevents the accumulation of abrasive particles within the distribution system. In some embodiments, the slurry distribution system comprises a mixing tank, which is configured to generate a polishing mixture comprising a diluted slurry having abrasive particles that enable mechanical polishing of a workpiece. The polishing mixture is transported between the mixing tank and a CMP tool by way of a transport piping. An energy source is configured to transfer energy to a stimulating element that is in communication with the transport piping along a majority of its length. The stimulating element further transfers the energy to abrasive particles within the polishing mixture, thereby preventing accumulation of the abrasive particles within the transport piping.

Figure 2:
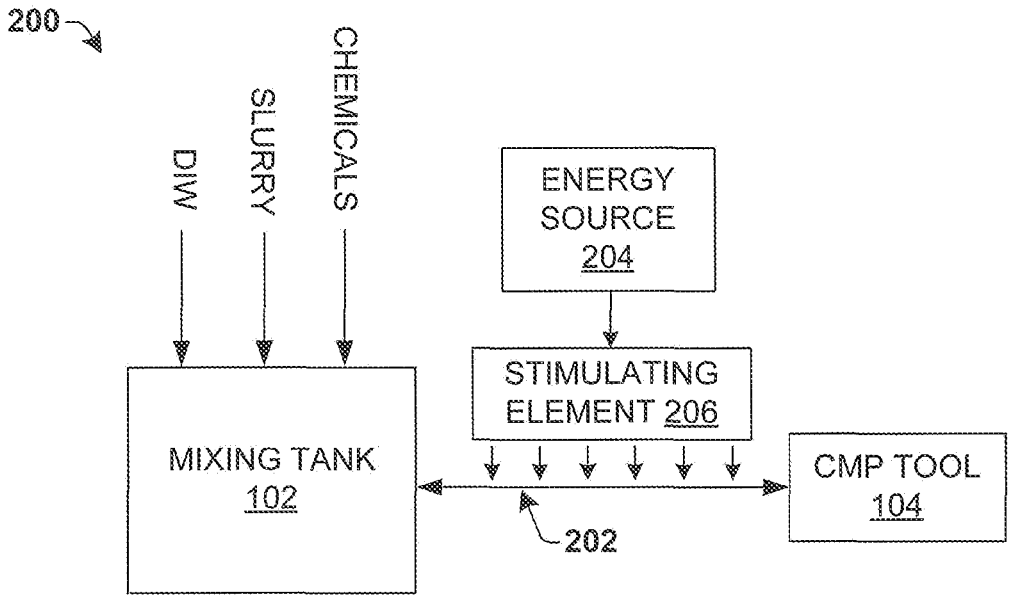
FIG. 2 illustrates a block diagram of some embodiments of a slurry distribution system as provided herein.

FIG. 2 illustrates a block diagram of some embodiments of a slurry distribution system 200 as provided herein. The slurry distribution system 200 comprises a mixing tank 102 connected to one or more CMP tools 104 by way of a transport piping 202.

The mixing tank 102 is configured to mix a concentrated slurry solution with a diluting agent, such as de-ionized water, to form a polishing mixture. The polishing mixture content may vary depending upon a material that is to be polished by the CMP tool 104. In general, the polishing mixture comprises a dilute slurry having abrasive particles that are used in mechanical polishing of a workpiece and one or more chemicals (e.g., $H_2O_2$, $NH_4OH$, etc.) that are used in chemical polishing of the workpiece.

The transport piping 202 is configured to transfer the polishing mixture between the mixing tank 102 and the one or more CMP tools 104. An energy source 204 is configured to provide electrical energy to a stimulating element 206 in communication with the transport piping 202. The stimulating element 206 is configured to convert the electrical energy to another form of energy, which is transferred to the abrasive particles within the polishing mixture. In some embodiments, the energy source 204 and stimulating element 206 comprise an atomizer configured to transfer energy through momentum and/or heat transfer. In other embodiments, the energy source 204 and stimulating element 206 may utilize alternative energy transport methodology. The transferred mechanical energy prevents the abrasive particles from condensing/accumulating on the sidewall of the transport piping 202. By preventing accumulation of abrasive particles, the formation of large chunks of accumulation within the transport piping 202 is avoided and wafer defects resulting from the large chunks of accumulation are prevented.

In some embodiments, the stimulating element 206 is comprised within the transport piping 202. In other embodiments, the stimulating element 206 is located external to the transport piping 202. In some embodiments, the stimulating element 206 runs along a length of the transport piping 202. In one such embodiment, the stimulating element 206 is configured to transfer energy to abrasive particles that are located in close proximity to the stimulating element 206, rather than to abrasive particles throughout the entire length of the transport piping 202. For example, in an embodiment, the stimulating element 206 may transfer energy in a substantially radial direction to abrasive particles within the transport piping 202.

Figure 3:
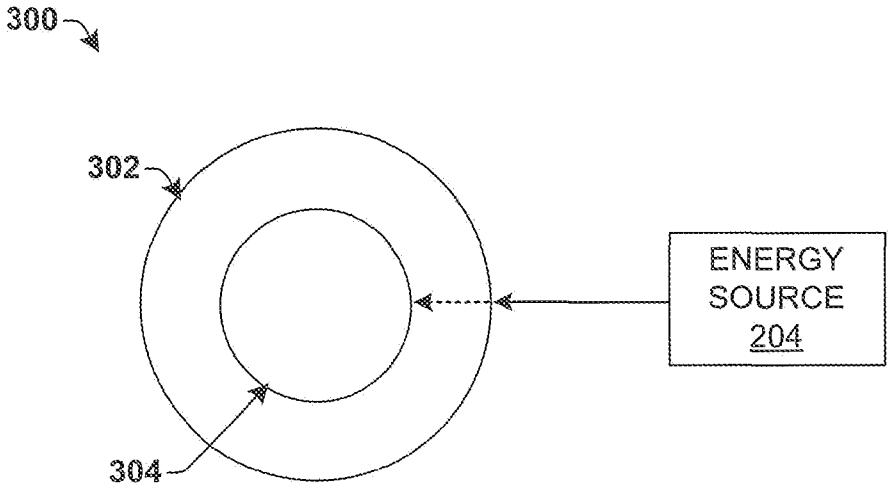
FIG. 3 illustrates a cross sectional view of some embodiments of a transport piping comprising a double tube.

In some embodiments, the transport piping 202 and stimulating element 206 comprise a double tube comprising one tube that is configured to transport polishing mixture and another tube that is operated as a stimulating element. FIG. 3 illustrates a cross sectional view of some embodiments of a transport piping comprising a double tube 300. Although, FIG. 3 illustrates the first tube 302 and the second tube 304 as coaxial tubes, such that the first tube 302 is concentric with the second tube 304, it will be appreciated that this is a non-limiting embodiment. In other embodiments, the first tube 302 and the second tube 304 are not concentric with each other. Furthermore, it will be appreciated that the term "double tube" as provided herein is not limited to structural configurations comprising two tubes, but may include structural configurations having one or more tubes comprised within another tube.

Double tube 300 comprises a first tube 302 and a second tube 304, wherein the second tube 304 is comprised within the first tube 302. In some embodiments, the second tube 304 is comprised within the first tube 302 along the entire length of the first tube 302. This causes the liquid within the first tube 302 to be in contact with the second tube 304 along the entire length of the second tube 304.

One of the first tube 302 or the second tube 304 is configured to transport a polishing mixture, while the other of the first tube 302 or second tube 304 is configured to comprise a stimulating liquid that operates as a stimulating element (e.g., corresponding to stimulating element 206 in FIG. 2). An energy source 204 is connected to the tube comprising a stimulating liquid and is configured to provide energy to the stimulating liquid therein. The energy is subsequently transferred from the stimulating liquid to abrasive particles within the polishing mixture. Therefore, the structure of the double tube 300 allows for the energy to be easily transferred from the energy source 204 to the abrasive particles along a length of the double tube 300.

Figure 4:
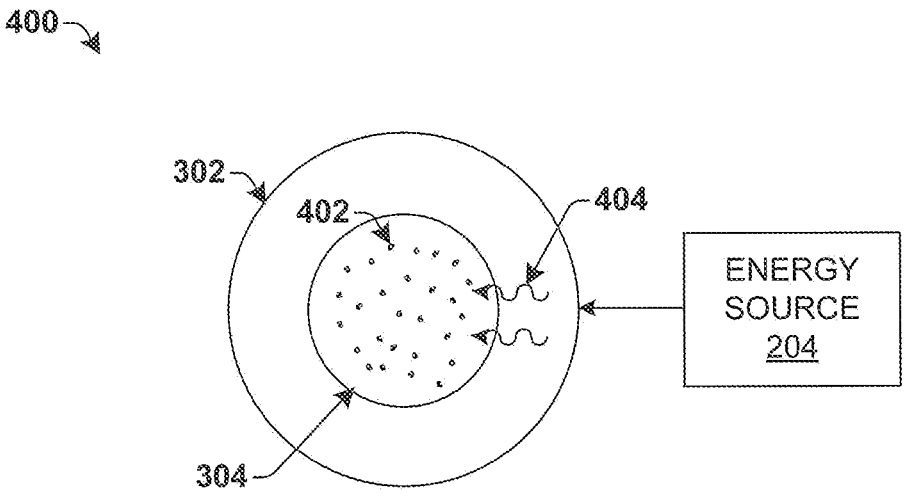
FIG. 4 illustrates a cross sectional view of an embodiments of a transport piping comprising a double tube.

In some embodiment, shown in the cross sectional view 400 of FIG. 4, the outer, first tube 302 is configured to transport a stimulating liquid, while the inner, second tube 304 is configured to transport a polishing mixture comprising abrasive particles. In such embodiments, the energy source 204 is connected to the first tube 302, which operates as a stimulating element. The energy source 204 is configured to provide electrical energy to the stimulating liquid within the first tube 302. The stimulating liquid converts the energy to another form and then transfers the converted energy to abrasive particles within the second tube 304.

Figure 5:
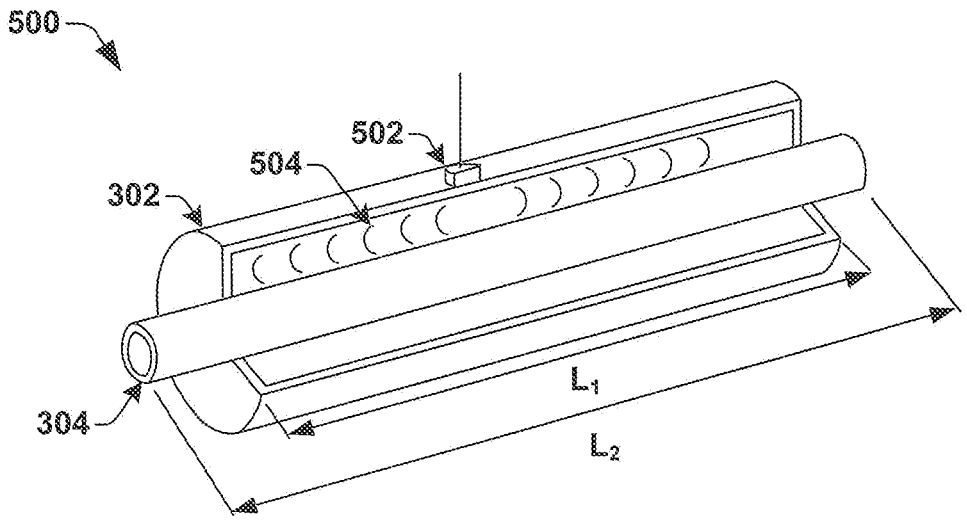
FIG. 5 illustrates a three-dimensional view of an embodiment of a double tube.

It will be appreciated that a stimulating element (e.g., corresponding to element 206 in FIG. 2) may extend along the entire length of the transport piping (e.g., element 202) or along some subset of the entire length. FIG. 5 illustrates a three dimensional view of a double tube 500, wherein the stimulating element extends along a subset of the entire length the transport piping. As shown in FIG. 5, a first tube 302 comprises a stimulating liquid and a second tube 304 comprises a polishing mixture. The first tube 302 of the double tube extends along a first length $L_1$ and the second tube 304 of the double tube extends along a second length $L_2$, wherein $L_2$ is larger than $L_1$.

In some embodiments, the disclosed slurry distribution system may comprise a plurality of stimulating elements, respectively having a length less than that of the transport piping comprising the polishing mixture. The plurality of stimulating elements are configured to extend along a portion of the transportation piping comprising the polishing mixture. For example, in an exemplary embodiment, the transport piping may comprise a plurality of stimulating elements that extend discontinuously along the transportation piping comprising the polishing mixture. In such an embodiment, each of the stimulating elements is configured to transport energy to the polishing mixture.

In some embodiments, the energy source is configured to generate energy within the stimulating liquid using an ultrasonic energy source. In one such embodiment, the energy source comprises one or more ultrasonic transducers 502 configured to provide energy to the stimulating liquid at a frequency of about 0-500 kHz, for example.

The one or more ultrasonic transducers 502 are configured to convert electrical energy to high frequency mechanical energy. The high frequency mechanical energy produces pressure waves 504 within the stimulating liquid. The pressure waves 504 travel through the stimulating liquid along the length of the double tube. The pressure waves 504 alternate between high pressure waves and low pressure waves, such that the stimulating liquid is compressed by the high pressure waves and decompressed by the low pressure waves. As the low pressure waves decompress the stimulating liquid, cavities form within the stimulating liquid. The high pressure waves then compresses the cavities, causing the cavities to implode and release energy. The energy is transferred to abrasive particles within the second tube 304 as mechanical energy. The mechanical energy prevents the accumulation of abrasive material on the walls of the second tube 304.

Figure 6:
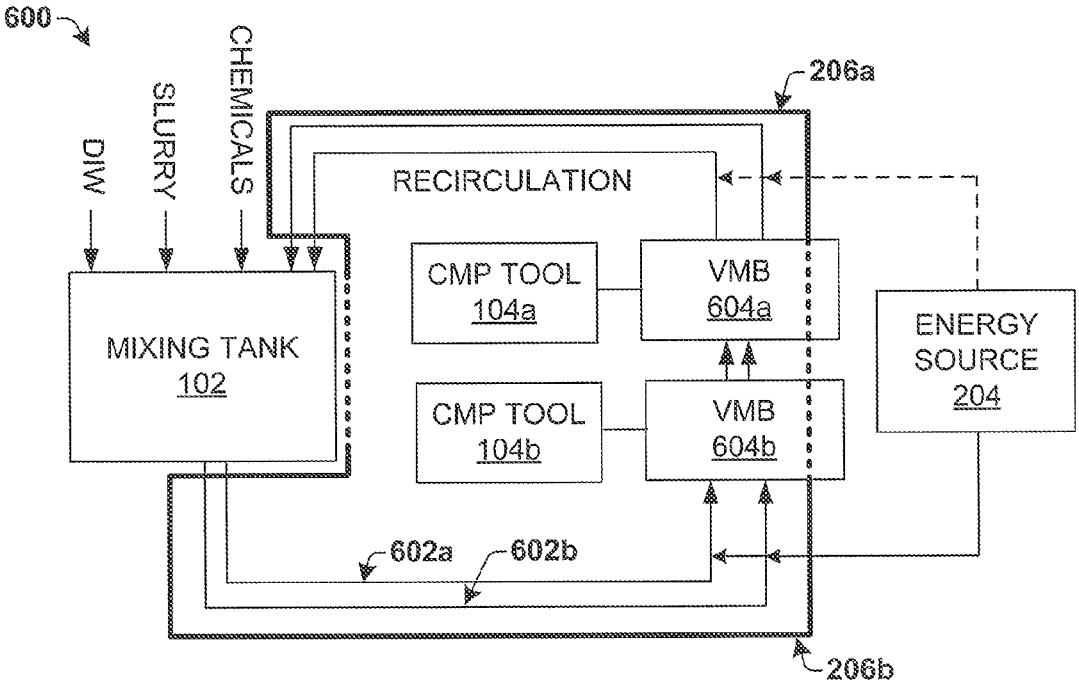
FIG. 6 illustrates a block diagram of some alternative embodiments of a slurry distribution system as provided herein.

FIG. 6 illustrates a block diagram of additional embodiments of a slurry distribution system 600 as provided herein. The slurry distribution system 600 comprises a mixing tank 102 connected to a transport piping comprising a first polishing mixture supply line 602*a* and a second polishing mixture supply line 602*b*. The mixing tank 102 is configured to receive an undiluted concentrated slurry, de-ionized water, and chemicals, and to mix together the undiluted slurry with the de-ionized water and chemicals to form a polishing mixture. The polishing mixture is provided to one or more valve manifold boxes 604, by way of the first and second polishing mixture supply lines, 602*a* and 602*b*. A valve manifold boxes 604 selectively provides the polishing mixture from the first or second polishing mixture supply lines, 602*a* and 602*b*, to a CMP tool 104 when the CMP tool 104 is operated to perform a chemical mechanical polishing.

In some embodiments, the first and second polishing mixture supply lines, 602*a* and 602*b*, comprise a distribution piping and a re-circulation piping. The distribution piping is configured to provide a polishing mixture from the mixing tank 102 to the one or more valve manifold boxes 604. The re-circulation piping is configured to return polishing mixture that has not been provided to the CMP tool 104 from the one or more valve manifold boxes 604 to the mixing tank 102, where the polishing mixture is further mixed to prevent precipitation of abrasive particles within the polishing mixture.

The energy source 204 is configured to provide energy to abrasive particles within both the first and second polishing mixture supply lines, 602*a* and 602*b*, by way of one or more stimulating elements. In some embodiments, the energy source 204 is coupled to a single stimulating element 206 that is configured to transfer energy along a length of the first and second polishing mixture supply lines 602*a* and 602*b*. In some other embodiments, the energy source is coupled to a first stimulating element 206*a* in contact with transport piping upstream of the one or more valve manifold boxes 604 and a second stimulating element 206*b* in contact with transport piping downstream of the one or more valve manifold boxes 604.

Figure 7A:
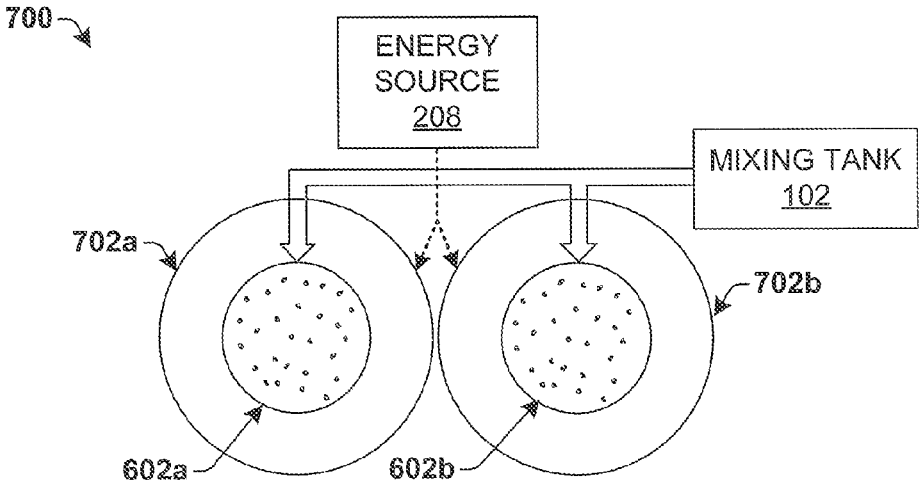
FIG. 7*a* illustrates a cross sectional view of an embodiment of a transport piping comprising two polishing mixture transport pipes.

FIG. 7*a* illustrates an embodiment of a double tube 700 comprising first and second polishing mixture supply lines, 602*a* and 602*b*. The double tube comprises a first stimulating tube 702*a* and a second stimulating tube 702*b* operating as a stimulating element. The first stimulating tube 702*a* comprises the first polishing mixture supply line 602*a* and the second stimulating tube 702*b* comprises the second polishing mixture supply line 602*b*. A stimulating liquid is comprised within the first and second stimulating tubes, 702*a* and 702*b*. An energy source 204 is configured to transfer energy to the stimulating liquid within the first and second stimulating tubes, 702*a* and 702*b*. The stimulating liquid operate as stimulating elements that respectively provide energy to abrasive particles within the first and second polishing mixture supply lines, 602*a* and 602*b*.

Figure 7B:
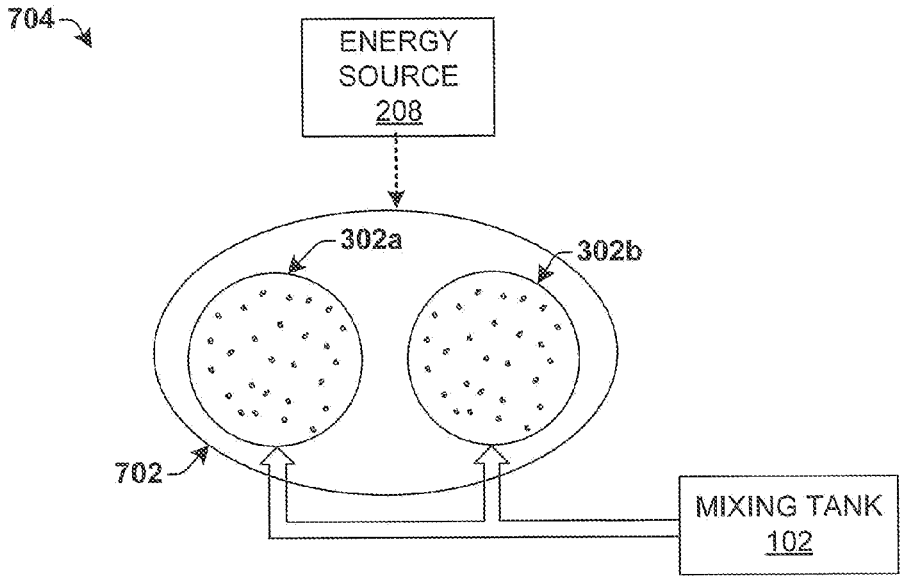
FIG. 7*b* illustrates a cross sectional view of an alternative embodiment of a transport piping comprising two polishing mixture transport pipes.

FIG. 7*b* illustrates an alternative embodiment of a double tube transport piping 704 comprising first and second polishing mixture supply lines, 602*a* and 602*b*. The double tube comprises a single stimulating tube 702 operating as a stimulating element. The single stimulating tube 702 comprises both the first and second polishing mixture supply lines, 602*a* and 602*b*. A stimulating liquid is comprised within the single stimulating tube 702. An energy source 204 is configured to transfer energy to the stimulating liquid. The stimulating liquid operates as a stimulating element that provides energy to the first and second polishing mixture supply lines, 602*a* and 602*b*.

Figure 8:
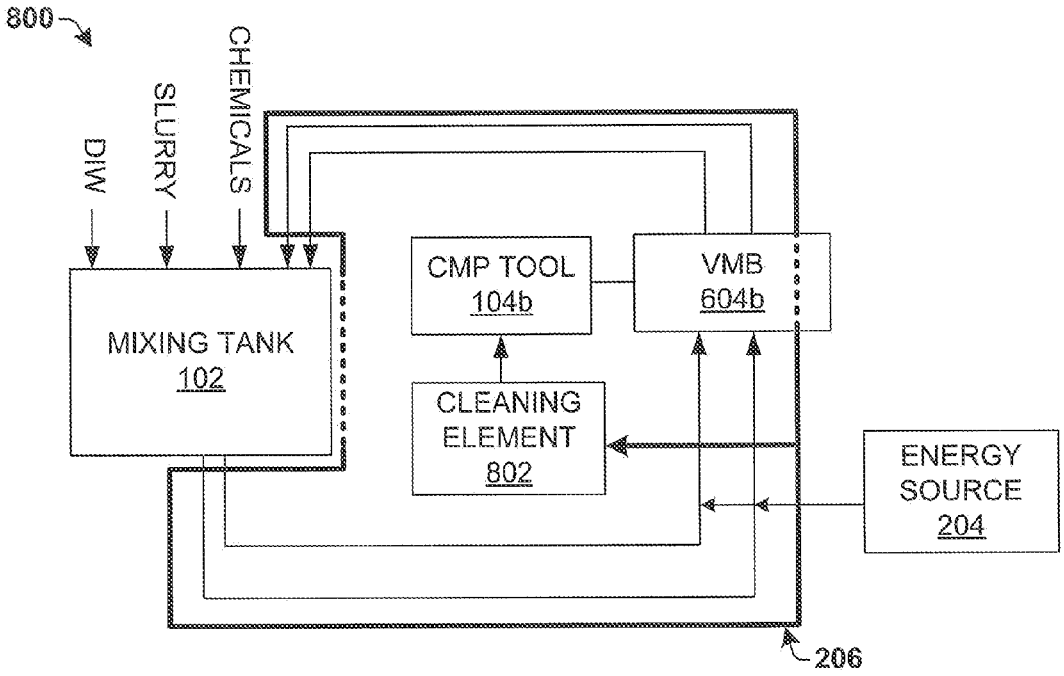
FIG. 8 illustrates some embodiments of a slurry distribution system, wherein a stimulating liquid is provided to a cleaning element configured to enable cleaning of one or more parts of a CMP tool.

In some embodiments, the slurry distribution system is configured to provide the stimulating liquid to a CMP tool for processes related to the CMP tool operation. FIG. 8 illustrates some embodiments of a slurry distribution system 800, wherein a stimulating liquid is provided to a cleaning element 802 configured to enable cleaning of one or more parts of a CMP tool 104. By cleaning the CMP tool 104, polishing efficiency of the CMP tool 104 is improved.

In some embodiments, the stimulating liquid is provided to a cleaning element 802 configured to clean a CMP polishing pad of the CMP tool 104 after polishing of a workpiece is performed. For example, one of ordinary skill in the art will appreciate that slurry accumulation on a CMP polishing pad causes a roughening of the polishing pad surface. Therefore, the stimulating liquid can be provided from the stimulating element 206 to a polishing pad of the CMP tool 104 to remove slurry accumulation from the polishing pad surface.

In some embodiments, the stimulating liquid may be provided from the stimulating element 206 to a cleaning element 802 comprising a high pressure micro jet system configured to condition the CMP polishing pad. In such an embodiment, the stimulating liquid may comprise de-ionized water. The high pressure micro jet system is configured to highly pressurize (e.g., 10-30 MPa) the de-ionized water, before it is sprayed as small droplets onto the CMP polishing pad with a high speed. The water droplets condition the polishing pad, for example, by removing debris and slurry residue.

Figure 9:
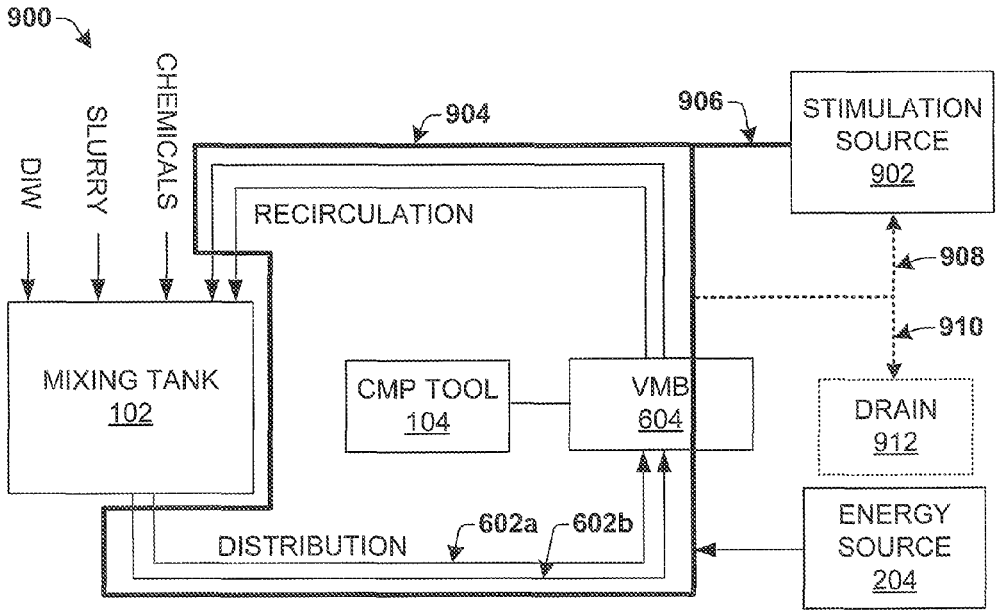
FIG. 9 illustrates a block diagram of an alternative embodiments of a slurry distribution system as provided herein.

FIG. 9 illustrates a block diagram of another embodiment of a slurry distribution system 900, wherein the stimulating liquid is provided from a stimulating liquid source to at least one stimulating tube of a transport piping comprising a double tube.

As shown in FIG. 9, a transport piping comprises a first and second polishing mixture supply lines 602*a* and 602*b* and a stimulating tube 904 configured to comprise a stimulating liquid. The first and second polishing mixture supply lines 602*a* and 602*b*, are configured to transport polishing mixture between the mixing tank 102 and one or more valve manifold boxes 604. The stimulating tube 904 is configured to circulate the stimulating liquid along the length of the first and second polishing mixture supply lines 602*a* and 602*b*, so as to keep the stimulating liquid in contact with the first and second polishing mixture supply lines, 602*a* and 602*b*.

The stimulating tube 904 is connected to a stimulating liquid source 902 by way of a first conduit 906. The stimulating liquid source 902 is configured to provide stimulating liquid to the stimulating tube 904. In some embodiments, the stimulating tube comprise a plurality of stimulating tubes, operated separately. For example, a first value is operable to provide liquid from the stimulating liquid source 902 to a first stimulating tube, while a second value is operable to provide stimulating liquid from the stimulating liquid source 902 to a second stimulating tube.

In some embodiments, the stimulating liquid source 902 comprises a tank containing a stimulating liquid. In one such embodiment, the stimulating liquid source 902 provides de-ionized water to the stimulating tube 904 by way of the first conduit 906, while a second conduit 908 may be configured to provide the stimulating liquid back to the stimulating liquid source 902. In another embodiment, the stimulating liquid source 902 comprises a de-ionized water tap. In one such embodiment, the stimulating liquid source 902 provides de-ionized water to the stimulating tube 904 by way of the first conduit 906, while the de-ionized water is removed from the stimulating tube 904, by way of a third conduit 910 connected to an open drain 912.

In some embodiments, the stimulating tube 904 operate as a closed system. For example, the stimulating liquid source 902 and the stimulating tube 904 comprise a fluid system that is closed (i.e., that is self contained). The closed system can be easily added to the structure of existing CMP slurry distribution systems.

Figure 10:
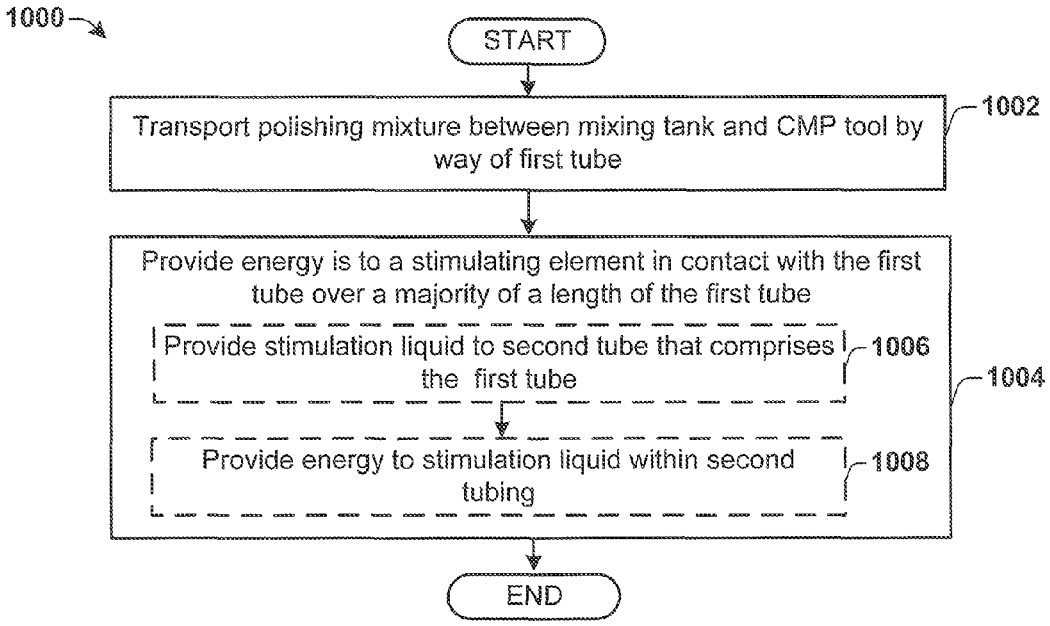
FIG. 10 is a flow diagram of some embodiments of a method for distributing a slurry based polishing mixture to a chemical mechanical polishing tool.

FIG. 10 illustrates a flow diagram of some embodiments of a method 1000 for distributing a slurry based polishing mixture to a chemical mechanical polishing tool. While the method 1000 provided herein is illustrated and described below as a series of acts or events, it will be appreciated that the illustrated ordering of such acts or events are not to be interpreted in a limiting sense. For example, some acts may occur in different orders and/or concurrently with other acts or events apart from those illustrated and/or described herein. In addition, not all illustrated acts may be required to implement one or more aspects or embodiments of the description herein. Further, one or more of the acts depicted herein may be carried out in one or more separate acts and/or phases.

At 1002 a polishing mixture is transported between a mixing tank and a chemical mechanical polishing tool by way of one tube of a double tubing. The polishing mixture comprises a diluted slurry having abrasive particles that enable the chemical mechanical polishing tool to mechanically polish a workpiece.

At 1004 energy is provided to a stimulating element in contact with the first tube over a majority of a length of the first tube. The stimulating element is configured to transfer energy to the abrasive particles within the first tube, thereby preventing accumulation of the abrasive particles within the first tube. In various embodiments the stimulating element may transfer the energy by way momentum, heat, or other forms of energy transfer.

In some embodiments, providing energy to a stimulating element comprises providing a simulating liquid is provided to a second tube of the double tubing at 1006. In some embodiments, the second tube surrounds the first tube so as to keep the stimulating liquid in contact with the first tube containing the polishing mixture. In some embodiments, the stimulating liquid comprises de-ionized water.

At 1008 energy is provided to the stimulating liquid. In some embodiments, energy is provided to the stimulating liquid by converting electrical energy to a high frequency mechanical energy that produces ultrasonic pressure waves within the stimulating liquid.

Therefore, the method 1000 prevents the accumulation of abrasive particles within the double tubing, preventing the formation of large chunks of accumulation which damage a workpiece during chemical mechanical polishing.

It will be appreciated that equivalent alterations and/or modifications may occur to one of ordinary skill in the art based upon a reading and/or understanding of the specification and annexed drawings. The disclosure herein includes all such modifications and alterations and is generally not intended to be limited thereby. In addition, while a particular feature or aspect may have been disclosed with respect to only one of several implementations, such feature or aspect may be combined with one or more other features and/or aspects of other implementations as may be desired. Furthermore, to the extent that the terms "includes", "having", "has", "with", and/or variants thereof are used herein, such terms are intended to be inclusive in meaning—like "comprising." Also, "exemplary" is merely meant to mean an example, rather than the best. It is also to be appreciated that features, layers and/or elements depicted herein are illustrated with particular dimensions and/or orientations relative to one another for purposes of simplicity and ease of understanding, and that the actual dimensions and/or orientations may differ substantially from that illustrated herein.

What is claimed is:

1. A slurry distribution system for a chemical mechanical polishing tool, comprising:

a mixing tank configured to generate a polishing mixture comprising a diluted slurry mixture having abrasive particles that enable mechanical polishing of a workpiece;

a transport piping configured to transport the polishing mixture between the mixing tank and a chemical mechanical polishing (CMP) tool, wherein the transport piping comprises a first tube and a second tube;

a valve manifold box comprising one or more valves configured to selectively provide the polishing mixture to the CMP tool, wherein the first tube and the second tube are configured to separately transport the polishing mixture between the mixing tank and the valve manifold box;

one or more stimulating elements extending along a majority of the length of the transport piping; and an energy source configured to transfer energy to the abrasive particles by way of the one or more stimulating elements, thereby preventing accumulation of the abrasive particles within the transport piping.

2. The system of claim 1, wherein the one or more stimulating elements comprise a third tube comprising a stimulating liquid and a fourth tube comprising the stimulating liquid;

wherein the first tube is comprised within the third tube, so that the stimulating liquid within the third tube is in contact with the first tube; and wherein the second tube is comprised within the fourth tube, so that the stimulating liquid within the fourth tube is in contact with the second tube.

3. The system of claim 2, wherein the first tube and the third tube comprise concentric tubes; and wherein the second tube and the fourth tube comprise concentric tubes.

4. The system of claim 2, wherein the stimulating liquid comprises de-ionized water.

5. The system of claim 2, further comprising:

a stimulating liquid source connected to the third tube or the fourth tube by way of a conduit and configured to provide the stimulating liquid to the third tube or the fourth tube, wherein the stimulating liquid source and the third tube or the fourth tube comprise a system that is closed with respect to the first tube or the second tube, respectively.

6. The system of claim 2, wherein the energy source comprises an ultrasonic transducer configured to convert electrical energy to high frequency mechanical energy that produces pressure waves within the stimulating liquid.

7. The system of claim 2, wherein the stimulating liquid is provided to a cleaning element configured to provide cleaning of a CMP polishing pad of the CMP tool after polishing of a workpiece is performed.

8. The system of claim 1, wherein the one or more stimulating elements comprise a third tube comprising a stimulating liquid; and wherein the first tube and the second tube are comprised within the third tube and configured to separately transport the polishing mixture between the mixing tank and the valve manifold box.

9. The system of claim 8, wherein the one or more stimulating elements comprise:

a first stimulating element in communication with a distribution tube located upstream of the valve manifold box and configured to transport polishing mixture from the mixing tank to the valve manifold box; and a second stimulating element in communication with a re-circulation piping located downstream of the valve manifold box and configured to transport polishing mixture from the valve manifold box to the mixing tank.

10. A slurry distribution system for a chemical mechanical polishing tool, comprising:

a mixing tank configured to generate a polishing mixture comprising a diluted slurry mixture having abrasive particles that enable mechanical polishing of a workpiece;

a double tube connected between the mixing tank and a chemical mechanical polishing (CMP) tool, wherein the double tube comprises:

a first tube configured to transport the polishing mixture between the mixing tank and the CMP tool, which has a first axis extending along a center of a cross-section of the first tube;

a second tube configured to transport a stimulating liquid, which has a second axis that is co-axial with the first axis and that extends along a center of a cross-section of the second tube; and an energy source configured to transfer energy to the stimulating liquid, which subsequently transfers the energy to the abrasive particles within the first tube, thereby preventing accumulation of the abrasive particles within the first tube.

11. The system of claim 10, wherein the second tube is comprised within the first tube and extends along the length of the first tube.

12. The system of claim 10, wherein the energy source is configured to transfer energy to the abrasive particles through momentum and/or heat transfer.

13. The system of claim 10, wherein the stimulating liquid comprises de-ionized water.

14. The system of claim 10, further comprising:

a stimulating liquid source connected to the second tube by way of a conduit, wherein the stimulating liquid source is configured to provide the stimulating liquid to the second tube as a closed system with respect to the first tube.

15. The system of claim 10, wherein the energy source comprises an ultrasonic transducer configured to convert electrical energy to high frequency mechanical energy that produces pressure waves within the stimulating liquid.

16. A method for distributing slurry for a chemical mechanical polishing tool, comprising:

transporting a polishing mixture comprising a diluted slurry mixture having abrasive particles between a mixing tank and a chemical mechanical polishing tool by way of a first tube having a first axis extending along a center of a cross-section of the first tube; and providing energy to a stimulating tube having a second axis co-axial with the first axis and extending along a center of a cross-section of the stimulating tube, wherein the stimulating tube is configured to transfer energy to the abrasive particles within the tube, thereby preventing accumulation of the abrasive particles within the first tube.

17. The method of claim 15, wherein the stimulating tube includes stimulating liquid comprising de-ionized water.

18. The method of claim 17, wherein providing energy to the stimulating liquid comprises converting electrical energy to a high frequency mechanical energy that produces ultrasonic pressure waves within the stimulating liquid.

19. The system of claim 10, further comprising:

a cleaning element configured to receive the stimulating liquid and to clean a CMP polishing pad of the CMP tool using the received stimulating liquid.

20. The method of claim 15, further comprising:

transporting the polishing mixture by way of a second tube; and operating a valve manifold box comprising one or more valves to selectively provide the polishing mixture to the CMP tool;

wherein the first tube and the second tube are surrounded by the stimulating tube, and are configured to separately transport the polishing mixture between the mixing tank and the valve manifold box.

* * * * *